US005550411A

United States Patent [19]

Baker

[11] Patent Number: 5,550,411

[45] Date of Patent: Aug. 27, 1996

[54] DOWNHOLE INSTRUMENT POWER SUPPLY SYSTEM USING SHUNT VOLTAGE REGULATION

[75] Inventor: Donald L. Baker, Ventura, Calif.

[73] Assignee: Westech Geophysical, Inc., Ventura, Calif.

[21] Appl. No.: 492,918

[22] Filed: Jun. 20, 1995

Related U.S. Application Data

[63] Continuation of Ser. No. 976,313, Nov. 12, 1992, abandoned.

[51] Int. Cl.[6] ..... G05F 1/613

[52] U.S. Cl. ..... 307/100; 323/223; 323/226; 323/220

[58] Field of Search ..... 363/80; 323/284, 323/311, 223, 226, 220; 361/18; 307/100

[56] References Cited

U.S. PATENT DOCUMENTS 4,008,418 2/1977 Murphy ..... 361/18
5,260,644 11/1993 Curtis ..... 323/226

OTHER PUBLICATIONS

Information Disclosure Statement dated Aug. 17, 1995 by Philip K. Shultz.
Information Disclosure Statement dated Aug. 8, 1995 by Donald L. Baker.

*Primary Examiner*—Peter S. Wong
*Assistant Examiner*—Aditya Krishnan
*Attorney, Agent, or Firm*—Fulwider Patton Lee & Utecht

[57] ABSTRACT

A downhole power supply system having a variable voltage surface power supply and a downhole shunt voltage regulator between which is disposed in series an energy transducing device. The shunt voltage regulator comprises a current control device which controls the amount of current shunted to the power return line between the series connected energy transducing device and the input to the voltage regulator to maintain a selected voltage at the voltage regulator. The shunt regulator senses the voltage on the power line, compares the sensed voltage to the selected voltage, and controls the shunt current control device to conduct more or less current in the event that the two voltages are not equal. As a result, changing the voltage at the remote power source will change the voltage across the transducing device and the amount of current conducted through it thus changing its output. In the case where the energy transducing device is a lamp, its intensity can be directly controlled by the voltage of the remote power source. Other voltage regulator features include over-voltage protection and reverse polarity protection.

20 Claims, 3 Drawing Sheets

DOWNHOLE INSTRUMENT POWER SUPPLY SYSTEM USING SHUNT VOLTAGE REGULATION

This application is a continuation, of application Ser. No. 07/976,313 filed Nov. 12, 1992 now abandoned.

BACKGROUND

The invention is related generally to power supply systems and more particularly, to downhole instrument power supply systems in which shunt voltage regulation is used.

Downhole camera systems permit the visual inspection of the interiors of otherwise inaccessible underground areas such as well casings. Such camera systems typically include a downhole "head" having a camera, a lighting system for illuminating the area being viewed by the camera, and other electronic components which perform control and data transfer functions. The head is connected to a surface power source and processing system by means of an umbilical cable.

In downhole camera systems, voltage regulation is usually needed because of the voltage sensitivity of one or more devices in the downhole head. Although some components in the downhole head, for example certain cameras, may operate acceptably on a relatively wide voltage range, for example, anywhere from 9 to 18 volts direct current (VDC), other equipment, such as data communications circuits, require voltage within a relatively narrow range, for example 12 VDC±5%.

Downhole video camera heads typically use 120 VDC/100 watt halogen lamps for illumination. The illumination provided by such lamps is directly related to the voltage provided to the lamp. A variable DC power supply is located at the surface to provide power for the lamp, camera and associated downhole electronics. The surface power supply is variable to allow the operator to adjust the lamp intensity for various hole conditions. A typical range is 40 through 120 volts at the downhole lamp. The camera and associated electronics require 12 VDC and must take that power from the same power source as the lamp. Therefore, a voltage regulator included in the downhole instrument is often used. As an example, a voltage regulator having the following specifications may be used:

output voltage of 12 VDC±0.1%;

output current of 250 milliamperes (ma) average;

input voltage variations from 40 through 120 VDC;

operating temperature range from 0° to 100° C.; and maximum power dissipation of less than 10 watts.

Surface control over the intensity of the downhole illumination has been found to be desirable due to the variability and unpredictability of conditions which may be found downhole. In some cases, immiscible media exist in a well, for example, water and oil. It has been found that it would be of value to visibly detect such media for the purpose of locating the entry point in the well of one or more of these media. For example, in an oil well having one or more side branches, it would be of value to lower the camera head to the points of these side branches to see if water is entering the well at those branches. Corrective action could then be taken if water is detected. It has been noted that such media detection is made easier when illumination at decreased levels is used. The layers of the media can more easily be seen under these reduced illumination levels whereas they are more difficult to see under high illumination levels.

On the other hand, inspection of a well casing having a turbid medium contained within requires a high intensity illumination so that the illumination will pierce the turbidity and illuminate the well casing. Illumination at low intensity would, in this case, be of limited value. Thus illumination control is desirable.

Due to size limitations and levels of heat to which a downhole camera head can be exposed during use, it is desirable to keep the downhole circuitry at a minimum in size, complexity, heat sensitivity, and heat generation, yet, voltage regulation is nevertheless required. Camera heads for well holes must be rugged to withstand the sometimes harsh conditions encountered in typical operation. For example, hydrostatic well pressures in excess of $4.2\times10^6$ kilograms per square meter (6,000 pounds per square inch) and high ambient well temperatures are not uncommon. This high heat in the environment makes it desirable to reduce the amount of internal heat generated by the camera head itself.

Because of the long lengths of umbilical cable often used with its inherent resistance, the voltage reaching the downhole camera head may vary from the voltage required, for example 12 VDC. In some cases, the voltage source at the surface is increased slowly from its minimum voltage, such as 40 volts, to a level above the downhole selected level. The voltage regulator in the camera head maintains the voltage applied to the electronics at the selected level regardless of how high above that level the voltage reaching the camera head from the surface is. In such a voltage regulator system, the surface operator need only set the surface voltage at some level above the selected level, and the downhole regulator will operate to reduce the voltage arriving through the umbilical cable to the desired level. For example, the surface voltage may be set at 40 VDC, the voltage arriving at the camera head may be 18 VDC due to cable resistance and the voltage regulator will reduce that voltage to 12 VDC before applying it to the camera head electronics.

It would be desirable for the technique used to regulate the voltage at the camera head to also contribute to controlling the illumination in response to surface action. This would result in fewer components in the camera head.

A further consideration in providing a power supply system having a downhole voltage regulator is the possibility of creating undesirable electromagnetic interference. If such interference is severe enough, signals may be corrupted. In many cases today, analog type cameras are used in the downhole camera head. The analog signal from the television camera, traveling on a lengthy cable to the surface, is particularly vulnerable to electromagnetic noise generated by any downhole device.

In the past, some downhole video camera systems have employed switching type voltage regulators. The 120 volt maximum input voltage of the voltage regulators in some systems coupled with the wide input voltage range (40 to 120 VDC in some systems) drove many designers to use switching technology. However, switching regulators have drawbacks that are unavoidable. They are noisy and complex. Electrical noise in a camera system is not desirable because it can degrade picture quality. Complexity in any downhole instrument, especially one used in the oil service industry, reduces reliability and makes repair difficult. The 100° C. temperature requirement further complicates the design.

Additionally, many switching type voltage regulators generate enough electromagnetic noise to corrupt the video signal sent to the surface. In many cases complex circuitry must be designed to remove this switching noise from the video display. This custom designed circuitry is not only costly but it also adds another element to the system which is subject to failure.

Driven by the desire for noise free, very simple, and highly reliable regulators, various analog regulators have been considered. The classic analog voltage regulator is a series pass element type. This type is very simple and reliable; however, because of the high input voltage, the pass element, such as a transistor, would have to dissipate an unacceptably high amount of power. The amount is unacceptable because it limits the regulator's use to environments having lower maximum temperatures. Above that maximum environmental temperature, the heat built up in the instrument would be above the transistor's operating temperature.

Hence, those skilled in the art have recognized the need for a downhole instrument power supply system which allows for surface control over the power applied to a downhole energy transducing device, such as a lamp, for controlling the output of that device while delivering a relatively precise regulated voltage to other co-located devices. Those skilled in the art have also recognized the need for a power supply system which has a reduced potential for generating electromagnetic noise which may interfere with the operating of other system components. There also exists a need for a design which generates less internal heat. The present invention fulfills these needs and others.

SUMMARY OF THE INVENTION

Briefly and in general terms, the present invention provides a downhole instrument power supply system using shunt voltage regulation. An energy transducing device is positioned in series between the remote variable voltage power supply and the shunt voltage regulator. The shunt voltage regulator comprises a current control device which controls the amount of current shunted to the power return line between the energy transducing device and the input to the voltage regulator.

The shunt voltage regulator in accordance with the invention also provides a regulated voltage to components disposed in parallel with itself, and therefore controls the shunt current control device to either conduct more or less shunt current to maintain the desired voltage across the shunt voltage regulator. As a result, varying the voltage of the remote power source will change the amount of current conducted through the transducing device and thus change the output of the energy transducing device but will not alter the regulated voltage provided by the shunt voltage regulator.

In another aspect, the line shunting the power line to the power return line located between the series energy transducing device and the shunt voltage regulator includes a semiconductor device for current control. The shunt voltage regulator senses the voltage at its input and controls the conductivity of the shunting semiconductor device to conduct more or less current to maintain a selected voltage at the input of the voltage regulator. A comparing circuit compares the sensed voltage to the selected voltage and in the event that they differ, controls the shunting semiconductor device to conduct more or less current as the case may be to remove the difference.

In yet another aspect in accordance with the invention, a reference voltage is amplified to a level below the selected voltage. The voltage sensed at the input to the shunt voltage regulator is divided and compared to the amplified reference voltage. An error signal is generated as a result of the comparison and that error signal is applied to the shunt current control device to control the shunt current.

In another aspect, the amplified reference voltage is divided and this divided voltage is compared to the reference voltage to control and make more precise the amplification of the reference voltage.

In yet a further aspect in accordance with the invention, voltage protection is provided. In one feature, an over-voltage protection circuit is provided which will shunt current from the input of the shunt voltage regulator to the power return line in the event that the line voltage exceeds a predetermined level. The over-voltage protection circuit includes a semiconductor device which when triggered, creates a separate shunt path to the return line between the energy transducing device and the input to the shunt voltage regulator. This second shunt path is additional to the voltage regulator shunt path containing the shunt current control device. Additionally, the over-voltage protection circuit may be reset by lowering the voltage from the remote power supply to a predetermined level, such as zero volts.

In a further feature to the voltage protection circuit, a reverse polarity protection circuit is provided which includes an additional current conducting device which will shunt all current between the power lines in the event that the voltage source at the surface is connected with reverse polarity to the power lines. This reverse polarity shunt will occur between the energy transducing device and the input to the shunt voltage regulator.

These and other aspects and advantages of the invention will become apparent from the following more detailed description when taken in conjunction with the accompanying drawings of illustrative embodiments.

DESCRIPTION OF THE PREFERRED EMBODIMENTS

Figure 1:
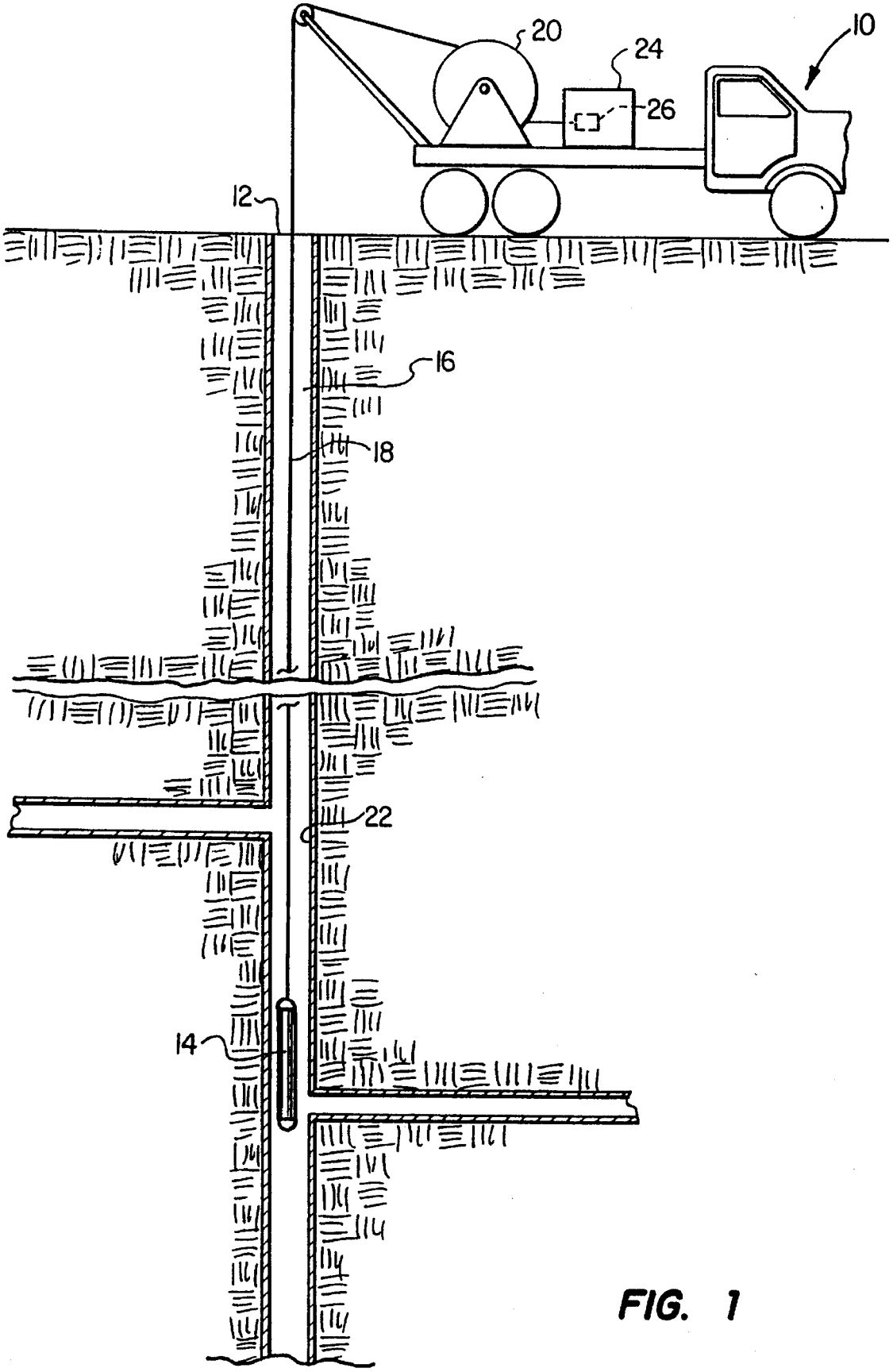
FIG. 1 presents a diagram of a well head measurement system presenting above-ground and camera head equipment in which a shunt voltage regulator in accordance with the principles of the invention may find application.

In the following description, like reference numerals will be used to refer to like or corresponding elements in the different figures of the drawings. Referring now to the drawings with more particularity, in FIG. 1 there is shown a typical downhole camera system in its typical working environment. The vehicle 10 transports the system to the well head 12, where the downhole camera head 14 is lowered into the well 16 by means of an umbilical cable 18 controlled by a motorized spool 20. The camera head 14 is used to inspect the well casing 22 while being supplied with power by the surface power source 26. The umbilical cable 18 may have quite a long length, for example, 15,000 ft. (4,573 meters) or longer.

Figure 2:
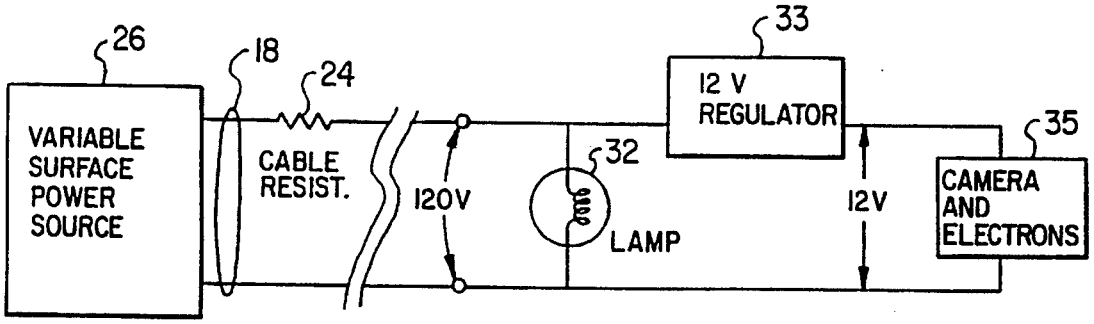
FIG. 2 (PRIOR ART)
FIG. 2 presents a diagram of a prior art voltage regulator which uses a series pass element.

FIG. 2 presents a schematic/block diagram of a prior art power supply system for a downhole instrument in which a series pass element type voltage regulator circuit 33 is used. A variable voltage surface power supply 26 provides power on an umbilical cable 18 to a downhole lamp 32, a voltage regulator 33 and camera and electronics block 35. The umbilical cable 18 is shown as having a certain cable resistance 27.

In the power supply system of FIG. 2, the lamp 32 is placed in parallel with the surface power source 26 so that varying the power source 26 output voltage will result in control over the intensity of the lamp 32. The voltage regulator 33 controls the voltage provided to the camera and electronics 35. However, because the voltage regulator 33 is a series pass type having a series element (not shown), a high input voltage of 120 VDC would require the series element, such as a transistor, to dissipate approximately 27 watts of power, assuming that the current required by the camera and electronics 35 is 250 milliamperes (mA). This amount of required dissipation on the pan of the series pass transistor would reduce the additional heat that the transistor could be exposed to by way of the environment. In one example, the approximate maximum temperature to which it could be exposed would be 40° C. This is too low a temperature for many applications and the value of a regulator of such a design would be limited.

Figure 3:
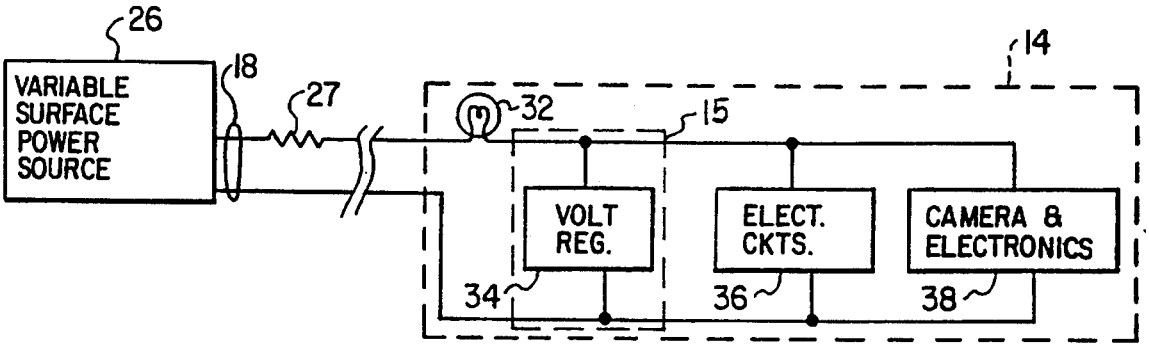
FIG. 3 presents an overall block diagram of a power supply system having a shunt voltage regulator in accordance with the principles of the invention.

FIG. 3 presents a block diagram of a downhole camera system power supply system having a shunt voltage regulator in accordance with the principles of the invention. The variable surface power source 26 provides the downhole components 14 with electric power through the umbilical cable 18. As in FIG. 2, the cable 18 has some cable resistance 27. A transducer device 32, in this case a lamp, may be controlled by varying the surface voltage, as will be described in more detail. The voltage regulator 34 which is in series with the energy transducing device 32 but in parallel with other downhole components 36 and 38 maintains the voltage reaching the other components, at a selected voltage, for example 12 VDC.

Figure 4:
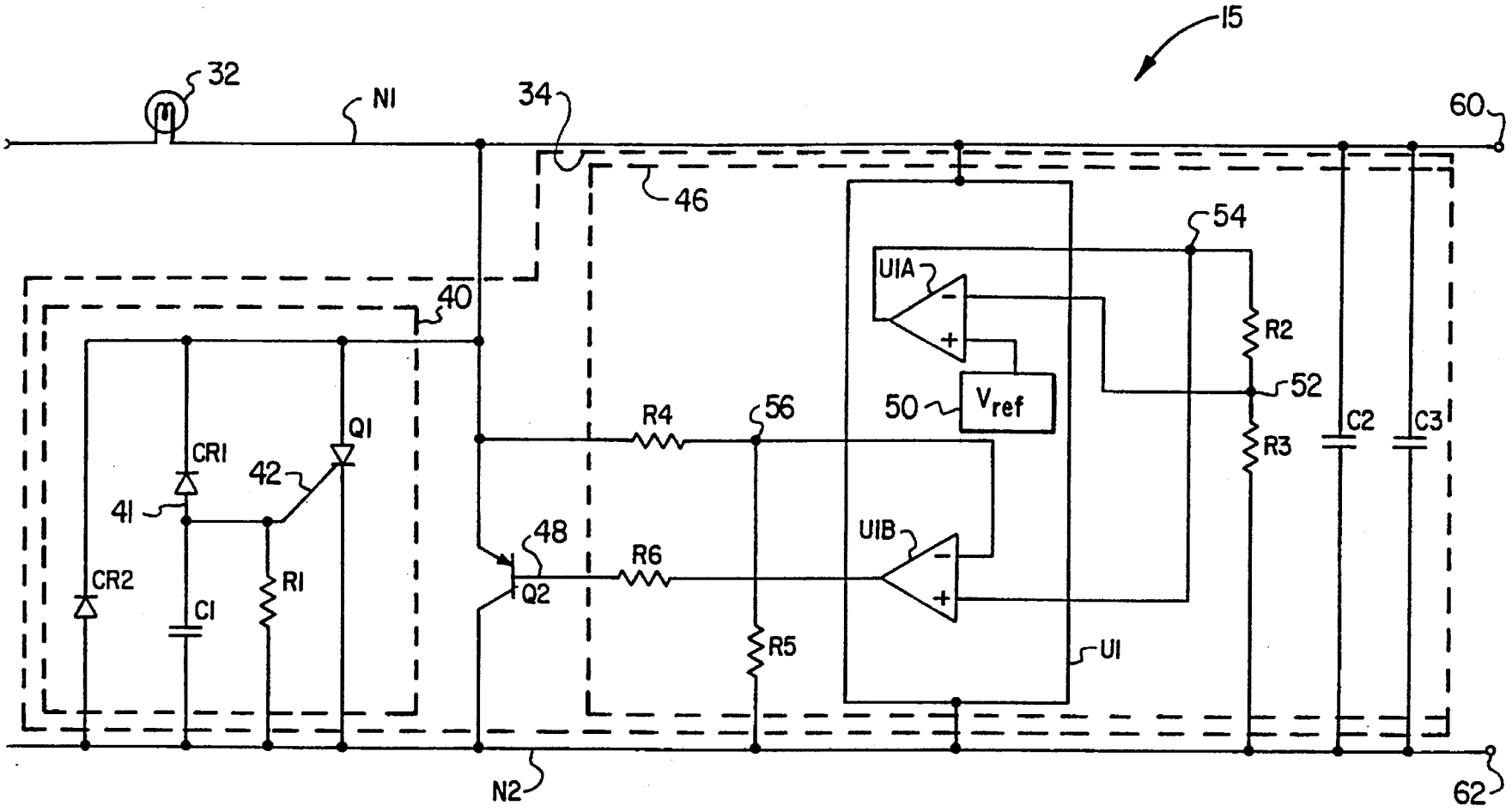
FIG. 4 presents a circuit diagram incorporating the principles of the invention and showing an over-voltage protection circuit, a reverse polarity protection circuit, a shunt current element, and a precise voltage sensing and control circuit.

Referring now to FIG. 4, the downhole part 15 of a power supply system embodying the principles of the invention is presented showing a shunt voltage regulator circuit 34 in greater detail. A voltage protection circuit 40 comprises an 18 volt Zener diode CR1 coupled between the power line (+12 VDC line) N1 and the gate 42 of an SCR Q1. The gate 42 of the SCR Q1 and the anode 41 of a zener diode CR1 are also coupled to the power return line N2 through a parallel RC circuit with a resistor R1 having a value of 100 ohms and a capacitor C1 having a value of 0.1 μF in this embodiment. This voltage protection circuit 40 keeps the gate of the SCR Q1 connected with the power return line N2 while isolating it from the noise which is typical of common lines and which could appear at the power return line N2.

Parallel to the above-described circuitry is the protective diode CR2 which is oriented so as to create a shunt from the power return line N2 to the power line N1 should a voltage of the wrong polarity (negative) be applied at the surface power source 26. In such an event, the diode CR2 would be forward biased and would therefore shunt current across the power return line N2 and the power line N1. The lamp would illuminate but no power would be available to the camera 38 or the electronics 36.

The shunt voltage regulator 15 also includes a shunt device Q2 connected in such a manner as to shunt current from the power line N1 to the power return line N2 in response to the control of a regulating circuit 46. The shunt device Q2 is a PNP transistor in this embodiment. The emitter of the shunt transistor Q2 (a TIP126 type) is coupled to the power line N1 and its collector is coupled to the return line N2. The shunt transistor Q2 is controlled by the regulating circuit 46, the control line 48 of which is coupled to the base of the shunt transistor Q2. The regulating circuit 46 comprises a pair of operational amplifiers (Op Amps), first Op Amp U1A and second On Amp U1B, contained in a single integrated circuit (IC), designated U1. Integrated circuit UI in this embodiment is an LM10CN, a widely available IC and has as one of its outputs a 200 millivolt reference voltage 50.

The 200 millivolt reference voltage 50 of IC U1 is coupled to the non-inverting input of the first Op Amp U1A. The output of the first Op Amp U1A is coupled to the power return line N2 through a series pair of reference voltage resistors R2 (10 KΩ) and R3 (2 KΩ). The node 52 between these resistors R2 and R3 is coupled to the inverting input of the first Op Amp U1A. The values of resistors R2 and R3 are set to cause the output of the first Op Amp U1A to be six times the 200 millivolt reference voltage in this embodiment thus equaling 1.2 volts. In this embodiment, the first Op Amp U1A additionally functions as a comparing circuit and compares the voltage on its inverting input to the voltage on its non-inverting input. The first Op Amp U1A adjusts its output in response to any difference between the input voltages to tend to equalize the input voltages.

The output of first Op Amp U1A is also coupled to the non-inverting input of the second Op Amp U1B at node 54. The inverting input of the second Op Amp U1B is coupled to the node 56 which is the node between the voltage dividing series pair of sensing resistors R4 (10 KΩ) and R5 (1.1 KΩ) which couple the power line N1 to the power return line N2. The values of the sensing resistors R4 and R5 are set so that the node 56 between them will have a voltage level of 1/10th that of the selected voltage. For example, where the selected voltage is 12 VDC, the voltage at the node 56 between the sensing resistors R4 and R5 will be 1.2 VDC, the same voltage as the output of the first Op Amp U1A. The output of the second Op Amp U1B is coupled through the current limiting resister R6 (21.5 KΩ) to the base of the shunt transistor Q2 thereby controlling its conductivity.

The capacitors C2 (0.1 μF) and C3 (1.0 μF) in this embodiment are attached between the power line N1 and the return line N2 to filter out any high frequency noise, such as that caused by switching in the load devices. The downhole part 15 of the power supply system also includes output terminals 60 and 62 for connecting the regulated voltage to the camera and other downhole electrical equipment (FIG. 3).

As the voltage output of the second Op Amp U1B is difficult to set with precision during manufacturing, the value of the resistor R5 is adjusted during manufacture such that the selected voltage, for example, 12 VDC, is produced at the power line N1 by the voltage regulator 34. Laser trimming of R5 may be performed to arrive at the correct value.

The zener diode CR1 used in this embodiment is a 1N5248; the SCR Q1, is an S4006L manufactured by TECCOR Electronics, Inc., 1801 Hurd Drive, Irving, Tex. 75038, and the protection diode CR2 is a 1N4004, also available from many sources of manufacture. The integrated circuit U1 is an LM10CN, which is widely available. In this particular embodiment, military grade devices were used to withstand the high temperatures experienced in actual operation.

In the embodiment shown in FIGS. 3 and 4, the energy transducing device 32 is a halogen lamp. Because it is in series on the 12 VDC line N1, and the voltage regulator 15 is of the shunt type, the intensity of the lamp 32 can be controlled by the voltage applied by the surface power source 26. The more the voltage from the surface exceeds 12 VDC, the more current will be conducted through Q2 and, therefore, through the lamp 32 thereby increasing its illumination output.

OPERATION

Should the voltage at the power line N1 exceed 12 VDC, the voltage at the inverting input of the second Op Amp U1B will exceed the 1.2 volt reference voltage at its non-inverting input causing it to generate an error signal. This error signal is coupled 48 to the base of the shunt transistor Q2 and will cause the shunt transistor Q2 to conduct more current from the power line N1 to the power return line N2 thereby causing the voltage drop across the energy transducing device 32 to increase. If the energy transducing device 32 is a lamp, its illumination will increase accordingly. As a result of the increased voltage drop across the transducing device 32, the voltage differential across the terminals of the shunt voltage regulator 34 will return to 12 VDC plus an infinitesimal error, which keeps the output of the second Op Amp U1B in an inverted state and thereby keeps shunt transistor Q2 in a conducting state. This allows for smooth steady state operation.

Should the voltage at the power line N1 fall below 12 VDC, the voltage at the inverting input of the second Op Amp U1B will fall below the 1.2 volt reference voltage at its non-inverting input causing the second 0p Amp U1B to generate a positive voltage output error signal. This error signal is coupled to the base of the shunt transistor Q2 and will cause the shunt transistor Q2 to conduct less current from the power line N1 to the power return line N2 thereby causing the voltage drop at the voltage regulator 34 to increase. If the energy transducing device 32 is a lamp, the light generated will decrease. As a result of the increased voltage drop across the voltage regulator, the voltage differential across the terminals of the shunt voltage regulator 34 will return to 12 VDC plus an infinitesimal error, which keeps Q2 conducting just enough current to maintain the 12 VDC level. This allows for smooth steady state operation.

When the camera head 14 is first activated, an operator typically gradually increases the surface voltage upwards from a minimum voltage, for example 40 VDC. As the voltage across the line N1 and return line N2 reaches 12 VDC, the shunt transistor Q2 will begin to conduct.

If the voltage at the power line N1 should rise above 18 VDC, the electrical resistance of the zener diode CR1 would fall to virtually zero. As a result, the voltage at the gate of the SCR Q1, which is coupled between the power line N1 and the return line N2, would rise to the point where the SCR Q1 would be triggered, causing its resistance to fall to virtually zero and causing the power line N1 to be effectively shunted to the power return line N2. As a result, the light will be powered but the camera and other electronic equipment will receive no power.

The shunt voltage regulation in accordance with the invention resulted in much less power to be dissipated by the regulator. For example, at the worst case of 120 VDC at the regulator terminals, and assuming as in the above example that the camera and electronics draw 250 mA of current, a halogen lamp at 120 VDC would draw approximately 833 mA for a total of 583 mA (833 mA–250 mA) to be dissipated by the regulator. At the 12 VDC level across the regulator, this results in a power dissipation of only 7 watts. A 7 watt dissipation level is one that commercial transistors can withstand at 100° C. Also the heat introduced into the instrument housing as a result of this 7 watt dissipation would be relatively small. This is roughly one-fourth of the power dissipation experienced by the series pass type regulator discussed above in relation to FIG. 2.

At the minimum voltage at the regulator terminals of 40 VDC, a halogen lamp draws approximately 300 mA. Because the camera and electronics draw only 250 mA, there is more than enough current to power this equipment.

It will be apparent from the foregoing that, while particular forms of the invention have been illustrated and described, various modifications can be made without departing from the spirit and scope of the invention. Accordingly, it is not intended that the invention be limited, except as by the appended claims.

What is claimed is:

1. A power supply system for providing variable voltage power to a first device and for regulating the power provided to a selected voltage and providing the regulated voltage power to a second device, the system comprising:

a variable voltage power source having a power line and a power return line, the voltage of the power source being controllable;

a shunt voltage regulator connected to the power line and the power return line and comprising:

a shunt line connected across the power line and the power return line of the power source;

a current control device disposed in the shunt line for controlling the amount of current flowing on the shunt line;

a voltage sensor for sensing the voltage across the power line and the power return line at the location of the voltage regulator and for providing a voltage error signal to the current control device in the event that the sensed voltage differs from the selected voltage;

wherein the current control device is responsive to the voltage error signal to control the amount of current flowing on the shunt line in accordance therewith to maintain the selected voltage across the power and power return lines;

wherein the first device is disposed in series between the controllable voltage power source and the shunt line of the voltage regulator thereby receiving an increased voltage across it in response to an increase in the power source voltage; and wherein the second device is connected to the voltage regulator to receive the regulated voltage power.

2. The system of claim 1 further comprising a voltage protection circuit coupled between the power line and the power return line between the first device and the voltage regulator, the voltage protection circuit comprising an over-voltage protection circuit which automatically shunts current between the power line and the power return line in the event that the voltage across said two lines exceeds a predetermined maximum, wherein no significant amount of current is available to the voltage regulator.

3. The system of claim 2 wherein the over-voltage protection circuit is resettable by lowering the voltage of the variable voltage source to provide a voltage at the voltage regulator that is below a predetermined reset voltage.

4. The system of claim 1 further comprising a reverse polarity protection circuit which automatically shunts current between the power return line and the power line in the event that the power source is connected to the power line and the power return line with polarity opposite a desired polarity, wherein no significant amount of current is available to the voltage regulator.

5. The system of claim 1 wherein the first device comprises a lamp which increases its light output as the voltage of the power source is increased.

6. The system of claim 5 wherein:

the variable voltage power source is located at a surface position and is connected through a cable to the first device and the voltage regulator, the cable housing the power line and the power return line;

the second device comprises a camera system having a normal operating voltage equal to the selected voltage;

wherein the greater the voltage of the power source, the greater the illumination provided by the lamp; and the first device, the voltage regulator, and the second device are collocated remotely from the power source.

7. The system of claim 1 wherein:

the voltage sensor comprises a reference voltage source which provides a reference voltage used in determining whether the sensed voltage differs from the selected voltage for generating the voltage error signal; and the current control device comprises a semiconductor device which is responsive to the error signal to increase the current through the shunt line in the event that the voltage across the power line and power return line is greater than the selected voltage and to reduce the current through the shunt line in the event that the voltage across the power line and power return line is less than the selected voltage.

8. The system of claim 7 wherein:

the reference voltage is a predetermined fraction of the selected voltage;

the voltage regulator further comprises:

an amplifier which increases the reference voltage to a greater fraction of the selected voltage;

a first voltage divider circuit which senses the voltage across the power line and the power return line and divides the sensed voltage;

a comparing circuit which compares the amplified reference voltage to the divided sensed voltage and in the event that they differ, provides the error signal representative of the difference to the current control device.

9. The system of claim 8 further comprising a second voltage divider circuit which divides the amplified reference voltage and provides that divided amplified reference voltage to the amplifier, the amplifier comparing the divided amplified reference voltage to the reference voltage and varies its amplification to reduce any difference between the two signals.

10. A power supply system for providing variable voltage power to a first device and for regulating the power to a selected voltage and providing the regulated voltage power to a second device, the system comprising:

a variable voltage power source having a power line and a power return line, the voltage of the power source being controllable;

a shunt voltage regulator collocated with the first and second devices and connected to the power line and power return line and comprising:

a shunt line connected across the power line and the power return line of the power source;

a current control device disposed in the shunt line for controlling the amount of current flowing on the shunt line;

a voltage sensor for sensing the voltage across the power line and the power return line at the location of the voltage regulator and for providing a voltage error signal to the current control device in the event that the sensed voltage differs from the selected voltage;

wherein the current control device is responsive to the voltage error signal to increase the amount of current flowing on the shunt line when the voltage across the power line and the power return line is greater than the selected voltage and to reduce the amount of current flowing on the shunt line when the voltage across the power line and the power return line is less than the selected voltage to maintain the selected voltage across the power and power return lines;

wherein the first device comprises an energy transducing device whose output increases with increased power supply voltage and which is disposed in series between the power source and the shunt line of the voltage regulator thereby receiving an increased voltage across it in response to an increase in the power source voltage;

wherein the second device is connected to the voltage regulator to receive the voltage regulated power; and the first and second devices being essentially collocated at a position remote from the power source.

11. The system of claim 10 further comprising a voltage protection circuit coupled between the power line and the power return line between the first device and the voltage regulator, the voltage protection circuit comprising an over-voltage protection circuit which automatically shunts current between the power line and the power return line in the event that the voltage across said two lines exceeds a predetermined maximum, wherein no significant amount of current is available to the voltage regulator.

12. The system of claim 11 wherein the over-voltage protection circuit is resettable by lowering the voltage of the variable voltage source to provide a voltage at the voltage regulator that is below a predetermined reset voltage.

13. The system of claim 10 further comprising a reverse polarity protection circuit which automatically shunts current between the power return line and the power line in the event that the power source is connected to the power line and the power return line with polarity opposite a desired polarity, wherein no significant amount of current is available to the voltage regulator.

14. The system of claim 10 wherein:

the variable voltage power source is located at a surface position and is connected through a cable to the first device and the voltage regulator, the cable housing the power line and the power return line;

the first device comprises a lamp which provides increased illumination in response to increased voltage of the power supply;

the second device comprises a camera system having a normal operating voltage equal to the selected voltage; and the first device, the voltage regulator, and the second device are collocated remotely from the power source.

15. The system of claim 10 wherein:

the voltage sensor comprises a reference voltage source which provides a reference voltage used in determining whether the sensed voltage differs from the selected voltage for generating the voltage error signal; and the current control device comprises a semiconductor device which is responsive to the error signal to increase the current through the shunt line in the event that the voltage across the power line and power return line is greater than the selected voltage and to reduce the current through the shunt line in the event that the voltage across the power line and power return line is less than the selected voltage.

16. The system of claim 15 wherein:

the reference voltage is a predetermined fraction of the selected voltage;

the voltage regulator further comprises:

an amplifier which increases the reference voltage to a greater fraction of the selected voltage;

a first voltage divider circuit which senses the voltage across the power line and the power return line and divides the sensed voltage;

a comparing circuit which compares the amplified reference voltage to the divided sensed voltage and in the event that they differ, provides the error signal representative of the difference to the current control device.

17. The system of claim 16 further comprising a second voltage divider circuit which divides the amplified reference voltage and provides that divided amplified reference voltage to the amplifier, the amplifier comparing the divided amplified reference voltage to the reference voltage and varies its amplification to reduce any difference between the two signals.

18. A downhole power supply system for providing variable voltage power to a first device and for regulating the power to a selected voltage and providing the regulated voltage power to a second device, the first and second devices being essentially collocated in a downhole instrument at a downhole position, the system comprising:

a variable voltage power source located at a surface position remote from the downhole instrument, the power source having a power line and a power return line housed in a cable, the voltage of the power source being controllable;

a shunt voltage regulator collocated with the first and second devices and connected to the power line and power return line and comprising:

a shunt line connected across the power line and the power return line of the power source;

a current control device disposed in the shunt line for controlling the amount of current flowing on the shunt line;

a voltage sensor for sensing the voltage across the power line and the power return line at the location of the voltage regulator and for providing a voltage error signal to the current control device in the event that the sensed voltage differs from the selected voltage;

wherein the current control device is responsive to the voltage error signal to increase the amount of current flowing on the shunt line when the voltage across the power line and the power return line is greater than the selected voltage and to reduce the amount of current flowing on the shunt line when the voltage across the power line and the power return line is less than the selected voltage to maintain the selected voltage across the power and power return lines; and wherein the first device comprises a lamp which increases its light output as the voltage of the power supply is increased and which is disposed in series between the power source and the voltage regulator whereby the greater the voltage of the power source, the greater the illumination provided by the lamp; and wherein the second device comprises a camera system having a normal operating voltage equal to the selected voltage connected to the voltage regulator to receive the regulated voltage power.

19. The system of claim 18 wherein:

the voltage sensor comprises a reference voltage source which provides a reference voltage having a predetermined relationship to the selected voltage and used in determining whether the sensed voltage differs from the selected voltage for generating the voltage error signal; and the current control device comprises a semiconductor device which is responsive to the error signal to increase the current through the shunt line in the event that the voltage across the power line and power return line is greater than the selected voltage and to reduce the current through the shunt line in the event that the voltage across the power line and power return line is less than the selected voltage.

20. A downhole power supply system for providing variable voltage power to an illumination device and for providing power regulated to a selected voltage to a sensor, the illumination device and the sensor being collocated in a downhole instrument at a downhole position, the system comprising:

a variable voltage power source located at a surface position remote from the downhole instrument, the power source having a power line and a power return line housed in a cable connected to the downhole instrument, the voltage of the power source being controllable;

a shunt voltage regulator collocated with the illumination device and the sensor and connected to the power line and power return line and comprising:

a shunt line connected across the power line and the power return line of the power source;

a current control device disposed in the shunt line for controlling the amount of current flowing on the shunt line;

a voltage sensor for sensing the voltage on the power line at the location of the voltage regulator and for providing a voltage error signal to the current control device in the event that the sensed voltage differs from the selected voltage;

wherein the current control device is responsive to the voltage error signal to increase the amount of current flowing on the shunt line when the voltage across the power line and the power return line is greater than the selected voltage and to reduce the amount of current flowing on the shunt line when the voltage across the power line and the power return line is less than the selected voltage, to maintain the selected voltage across the power and power return lines;

wherein the illumination device is disposed in series between the power source and the voltage regulator and increases its light output as the voltage of the power source is increased, whereby the greater the voltage of the power source, the greater the illumination provided by the lamp; and wherein the sensor has a normal operating voltage equal to the selected voltage and is connected to the voltage regulator to receive the regulated voltage power.

* * * * *